US005652002A

United States Patent [19]

Kobayashi

[11] Patent Number: 5,652,002

[45] Date of Patent: Jul. 29, 1997

[54] VIBRATION APPARATUS FOR CONCRETE MOLDING BOX

[76] Inventor: Shigeru Kobayashi, 401-2, Karigane-cho, Ayanokoji-sagaru, Iwagami-dori, Shimogyo-ku, Kyoto, Japan

[21] Appl. No.: 721,704

[22] Filed: Sep. 27, 1996

[30] Foreign Application Priority Data

Jun. 28, 1996 [JP] Japan ..... 8-169822

[51] Int. Cl.[6] ..... B28B 1/08; B06B 1/16

[52] U.S. Cl. ..... 425/432; 425/456; 264/71; 74/61

[58] Field of Search ..... 425/425, 432, 425/456; 264/71; 74/61

[56] References Cited

U.S. PATENT DOCUMENTS

| | | | |
|---|---|---|---|
| 4,830,597 | 5/1989 | Steier et al. | 425/456 |
| 5,496,132 | 3/1996 | Pelletier | 425/456 |
| 5,496,167 | 3/1996 | Diaz | 425/456 |

FOREIGN PATENT DOCUMENTS

| | | |
|---|---|---|
| 6-272381 | 9/1994 | Japan . |
| 6-328423 | 11/1994 | Japan . |

*Primary Examiner*—Khanh P. Nguyen

*Attorney, Agent, or Firm*—Flynn, Thiel, Boutell & Tanis, P.C.

[57] ABSTRACT

A vibration apparatus for a molding box which enlarges the range in which a vibrating force can be increased and decreased. In the apparatus, a first gear pulley 16 for rotating a first rotary shaft having a first eccentric weight fixed thereto and a second gear pulley 17 for rotating a second rotary shaft having a second eccentric weight fixed thereto are disposed on the same plane, and similar third and fourth rotary shafts are disposed immediately below the first and second rotary shafts, respectively. An endless timing belt 37 is passed around a prime mover gear pulley 33 and a gear pulley 36 disposed on a slidable base 31 capable of horizontal displacement in such a manner as to extend from the lower side of the first gear pulley 16 to the upper side of the second gear pulley 17 and from the upper side of the fourth gear pulley 19 to the lower side of the third gear pulley 18, and the slidable base 31 can thus move in a direction parallel to the timing-belt 37.

2 Claims, 8 Drawing Sheets

VIBRATION APPARATUS FOR CONCRETE MOLDING BOX

BACKGROUND OF THE INVENTION

1. Field of the Invention

This invention relates to a vibration apparatus for a concrete molding box which imparts vibration in a vertical direction to a concrete molding box so that a dense and homogeneous product can be obtained when a concrete product is molded.

2. Description of the Prior Art

Apparatuses for vibrating a concrete molding box according to the prior art employ the construction wherein a weight is eccentrically fixed to each rotary shaft and vibration generated by rotating the rotary shaft is transmitted to a concrete molding box.

The optimum amplitude of vibration is different depending on the weight and packing ratio of a concrete product. When a vibrating force is changed, whenever necessary, during molding of the concrete product, a homogeneous product can be obtained at a high speed. Particularly in the case of concrete molding using a quick mold release system, the vibrating force must be changed during molding.

In the conventional vibration apparatus for a concrete molding box, however, the range in which the vibrating force can be increased or decreased is narrow, and the expansion of the range has been desired.

To satisfy the requirement described above, the present invention aims at providing an apparatus for vibrating a concrete molding box which expands the range in which the vibrating force can be increased or decreased.

SUMMARY OF THE INVENTION

The first aspect of the present invention relates to a vibration apparatus for a concrete molding box, which comprises a first rotary shaft having an eccentric weight fixed thereto; a third rotary shaft having an eccentric weight fixed thereto, and horizontally disposed immediately below, and in parallel with, the first rotary shaft; a second rotary shaft disposed in parallel with the first rotary shaft and having an eccentric weight fixed thereto, the eccentric weight being symmetric with that of the first rotary shaft; a fourth rotary shaft horizontally disposed immediately below the second rotary shaft and in parallel with the third rotary shaft and having an eccentric weight fixed thereto, the eccentric weight being symmetric with that of the third rotary shaft; the first to fourth rotary shafts having first to fourth gear pulleys for rotating the first to fourth rotary shafts, disposed on the same plane, respectively; an endless timing belt passed around a prime mover gear pulley and a gear pulley in such a manner as to extend from the lower side of the first gear pulley to the upper side of the second gear pulley and from the lower side of the third pulley to the upper side of the fourth gear pulley; and a support frame for supporting a concrete molding box at the upper end thereof, and receiving the vibration of the first and second rotary shafts and the vibration of the third and fourth rotary shafts at the lower end thereof. When a slidable base is moved by a driving source in a direction parallel to the timing belt, the timing belt rotates the first and third gear pulleys and the second and fourth gear pulleys in mutually opposite directions, and the phase of eccentricity of the first and third eccentric weights are changed symmetrically with respect to the phase of eccentricity of the second and fourth eccentric weights, and the amplitude of the vibration transmitted to the support frame from first to fourth rotary shafts can change within a broader range. Since the lower end of the support frame is a free end, the vibration transmitted to the support frame is restricted in a vertical direction by guide rods and is transmitted to the molding box.

The second aspect of the present invention relates to a vibration apparatus for a concrete molding box according to the first aspect, which uses, as a driving source, a hydraulic cylinder having a pulse encoder for controlling the protruding length of a piston rod, and which further includes a data storage device for storing the relation between the phases of eccentricities of the eccentric weights and the magnitude of the vibration of the support frame, and a controller for operating the hydraulic cylinder through the data storage device on the basis of vibration set input. The protruding length of the piston rod which varies for each pulse is registered in the data storage device, necessary displacement of the amplitude with respect to the product or the weight of the concrete product is stored in the data storage device, and the necessary number of revolutions and the data of the amplitude change are inputted to the data storage device. Then, the vibration transmitted to the support frame is automatically controlled.

DETAILED DESCRIPTION OF THE PREFERRED EMBODIMENTS

Hereinafter, an embodiment of the present invention will be explained with reference to the drawings.

Figure 1:
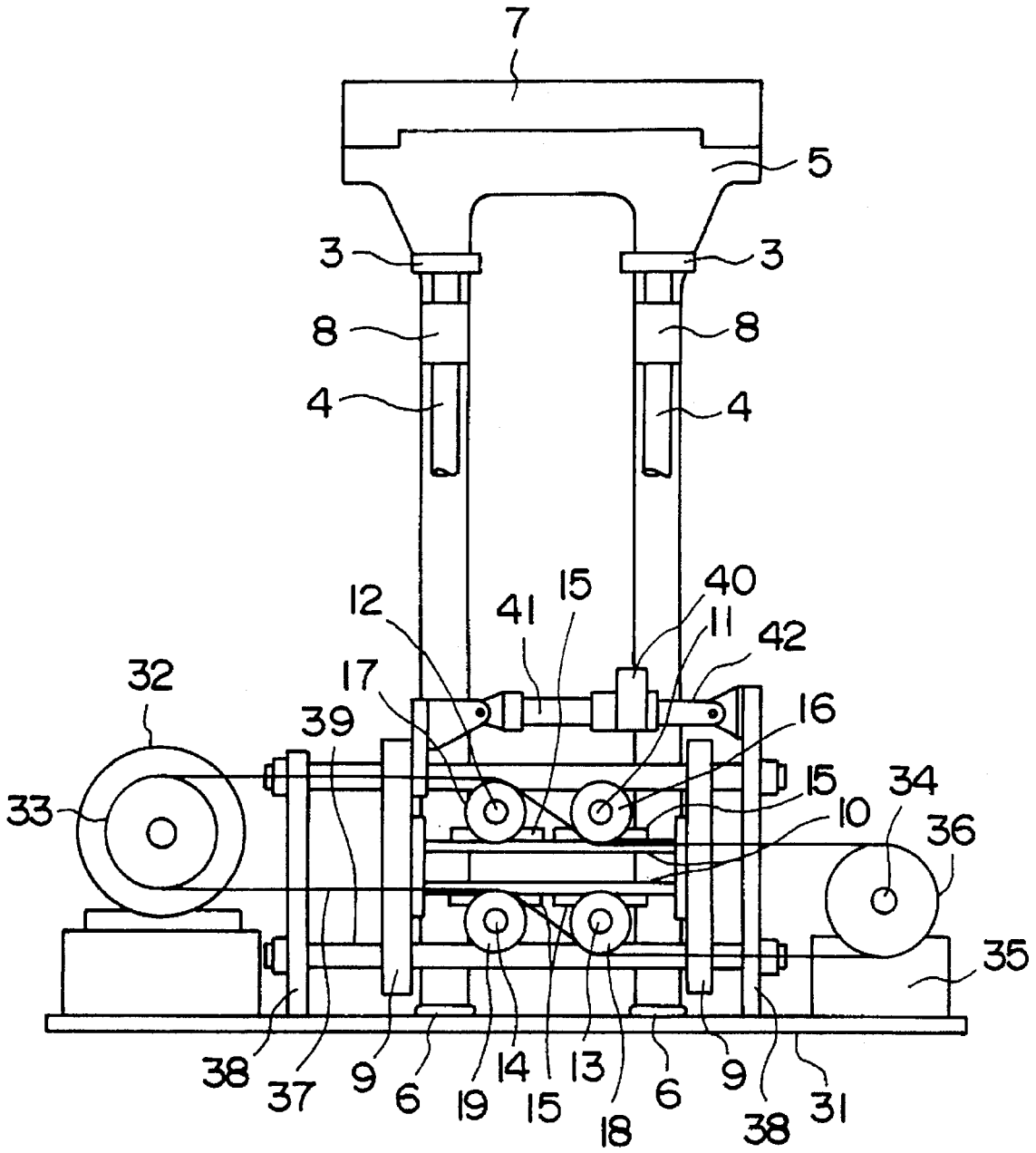
FIG. 1 is a front view showing an example of the embodiment of the present invention.
Figure 2:
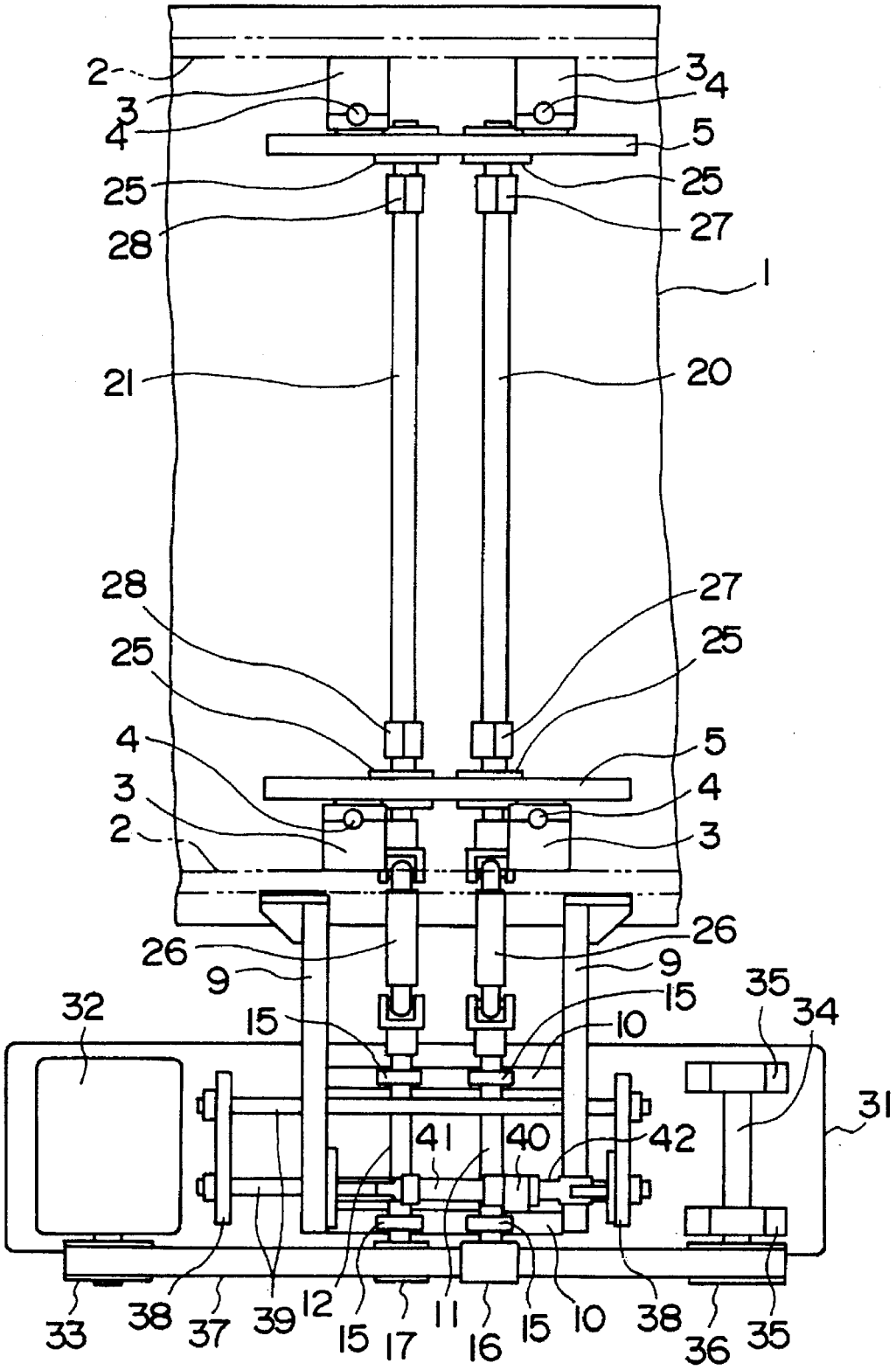
FIG. 2 is a plan view of FIG. 1.
Figure 3:
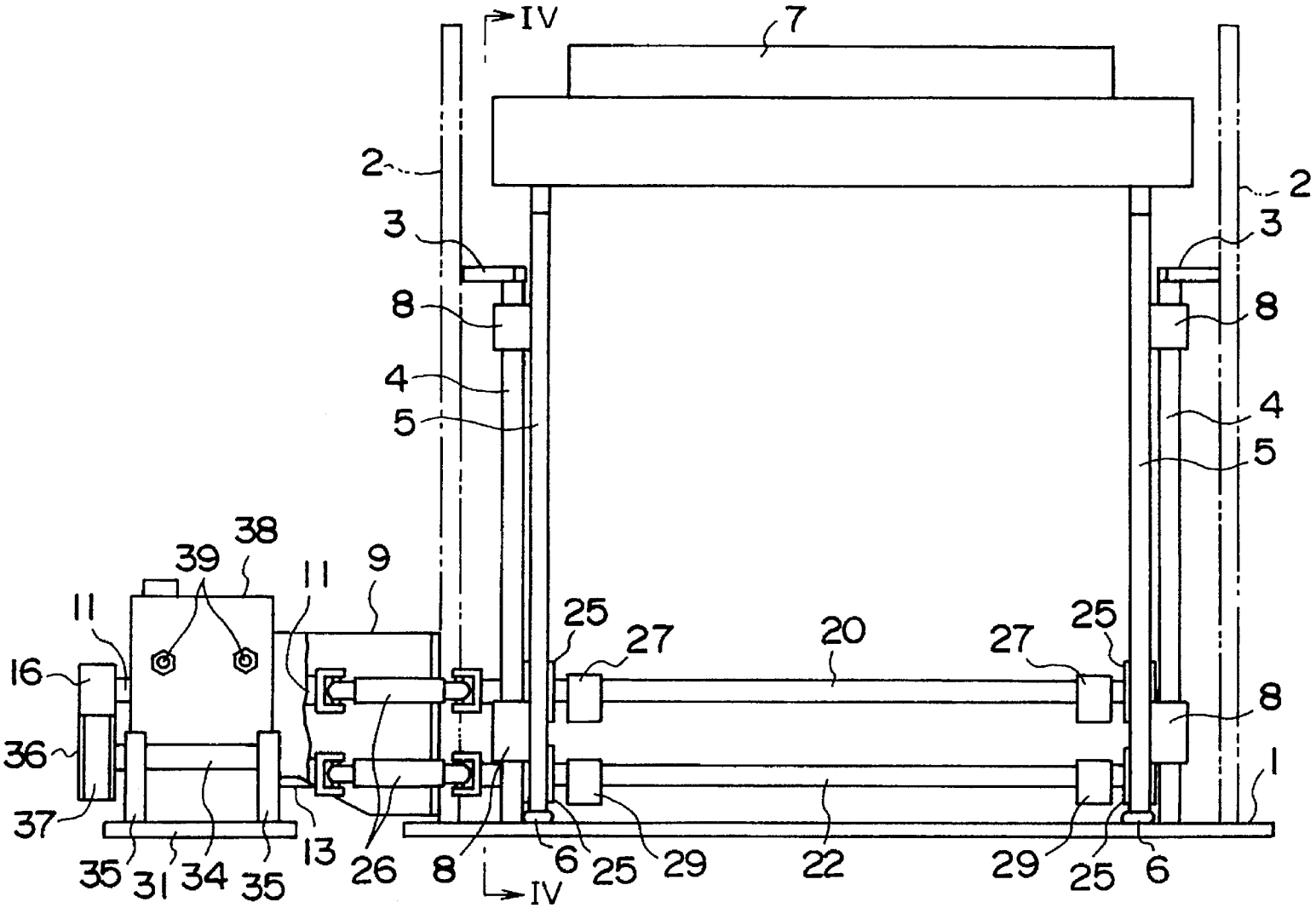
FIG. 3 is a right-hand side view of FIG. 1.
Figure 4:
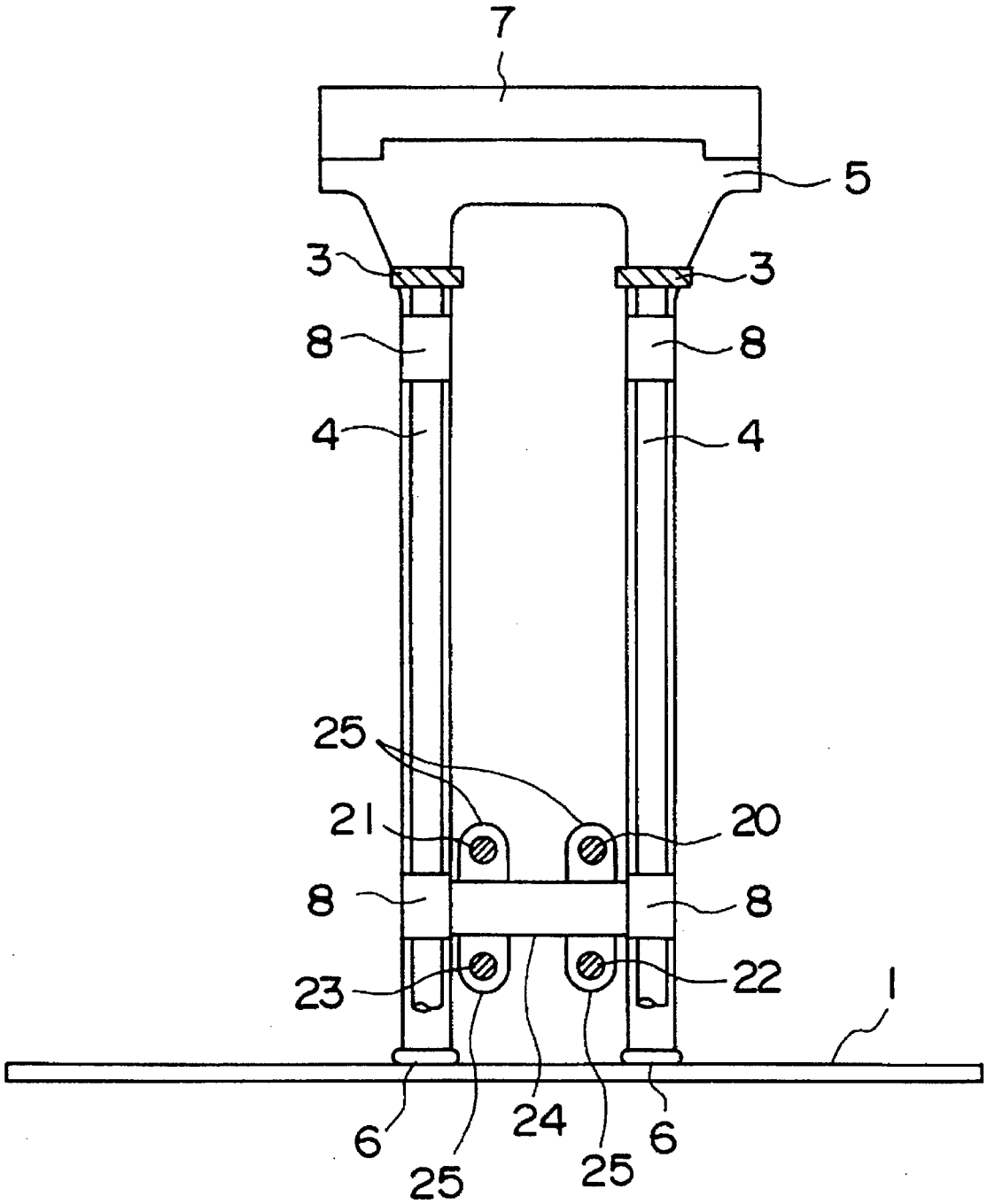
FIG. 4 is a sectional view taken along IV—IV of FIG. 3.

FIG. 1 is a front view showing an embodiment of the present invention, FIG. 2 is a plan view of FIG. 1, FIG. 3 is a right-hand side view of FIG. 1, and FIG. 4 is a sectional view taken along IV—IV of FIG. 3. A pair of machine frames 2 are perpendicularly fixed to a horizontal stationary bed plate 1 shown in FIGS. 2 to 4, and guide rods 4 are perpendicularly fixed between brackets 3 fixed to the upper portion of the machine frames 2 and the stationary bed plate 1.

As shown in FIGS. 1 to 4, a perpendicular support frame 5 is disposed at a position in the proximity of the guide rods 4, and the lower end of this support frame 5 is a free end. A pneumatic spring 6 is interposed between each end and the stationary bed plate 1 as shown in FIGS. 3 and 4 and the upper end of the support frame 5 is fixed to a concrete molding box 7.

Guide brackets 8 (FIGS. 3 and 4) are fixed to the upper and lower portions of the support frame 5 and are slidably fitted to the guide rods 4 so that the support frame 5 can undergo displacement along the guide rods 4 only in the vertical direction.

A pair of support brackets 9, which protrude forward, are fixed to the lower portion of the machine frame 2 which is perpendicularly fixed to the front side (foreground side in FIG. 2 and left side in FIG. 3) of the stationary bed plate 1, and a horizontal bearing support table 10 (see FIGS. 1 and 2) is fixed transversely between the pair of support brackets 9.

As shown in FIG. 1, a first gear pulley shaft 11 and a second gear pulley shaft 12 are disposed on the upper side of the bearing support table 10 while a third gear pulley shaft 13 and a fourth gear pulley shaft 14 are disposed on the lower side of the bearing support table 10. Each of these pulley shafts is disposed horizontally in the depth-wise direction.

The arrangement condition of these first to fourth gear pulley shafts 11 to 14 is as follows. Namely, the second gear pulley shaft 12 is disposed horizontally in the depth-wise direction at the same height as, and in parallel with, the first gear pulley shaft 11, the third gear pulley shaft 13 is disposed immediately below the first gear pulley shaft 11 and horizontally in the depth-wise direction in parallel with the first gear pulley shaft 11, and the fourth gear pulley shaft 14 is disposed immediately below the second gear pulley shaft and horizontally in the depth-wise direction in parallel with the second gear pulley shaft 12.

Each of these first to fourth gear pulley shafts 11 to 14 is rotatably supported by a bearing 15 (see FIGS. 1 and 2) fitted to the bearing support table 10.

A first gear pulley 16, a second gear pulley 17, a third gear pulley 18 and a fourth gear pulley 19 are fixed to the front end of the first gear pulley shaft 11, the second gear pulley shaft 12, the third gear pulley shaft 13 and the fourth gear pulley shaft 14 in such a fashion that these pulleys are positioned on one perpendicular plane.

As shown in FIGS. 2 to 4, a first rotary shaft 20, a second rotary shaft 21, a third rotary shaft 22 and a fourth rotary shaft 23 (see FIG. 4) are disposed below the support frame 5 in the same arrangement as that of the first to fourth gear pulley shafts 11 to 14. Both ends of each of these first to fourth rotary shafts 20 to 23 are rotatably supported by a bearing 25 fitted to the support frame 5 through a bearing support table 24 shown in FIG. 4.

The front end of each of these first to fourth rotary shafts 20 to 23 is interconnected to the rear end of each of the first to fourth gear pulley shafts 11 to 14 by an individual universal joint shaft 26.

A first eccentric weight 27 a second eccentric weight 28, a third eccentric weight 29 and a fourth eccentric weight 30 (see FIG. 6) are individually fixed to the first rotary shaft 20, the second rotary shaft 21, the third rotary shaft 22 and the fourth rotary shaft 23, respectively.

Figure 6:
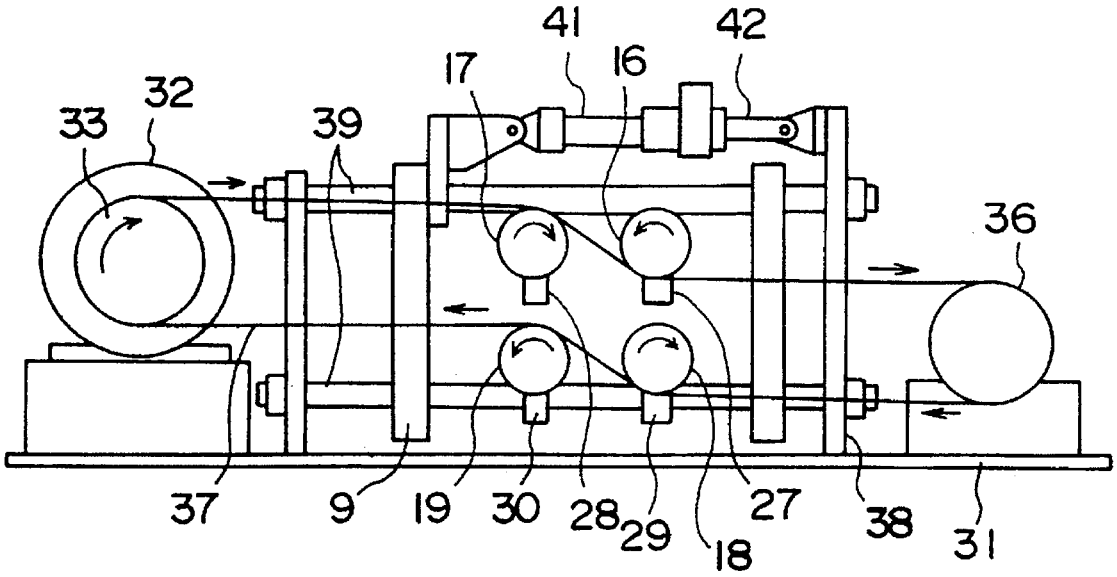
FIG. 6 is a front view of principal portions showing the operation state of the present invention.

Though FIGS. 2, 3 and 6 show the state where all of the first to fourth eccentric weights 27 to 30 are eccentric in the downward phase, the phases of eccentricities of these eccentric weights will be later described in detail.

As shown in FIGS. 1 and 2, a slidable base 31 is disposed below the positions of the first to fourth gear pulley shafts 11 to 14 and the first to fourth gear pulleys 16 to 19 in such a manner that it can undergo displacement horizontally in the transverse direction.

A prime mover gear pulley 33 driven for rotation by a motor 32 and a gear pulley 36 supported rotatably with a shaft 34 by a bearing 35 are disposed on the slidable base 31 in such a manner as to oppose each other while interposing the first to fourth gear pulleys 16 to 19 between them.

An endless timing belt 37 is passed around the prime mover gear pulley 33 and the gear pulley 36 as shown in FIG. 1 in such a manner as to extend from the lower side of the first gear pulley 16 to the upper side of the second gear pulley 17 and from the lower side of the third gear pulley 18 to the upper side of the fourth gear pulley 14 between the prime mover gear pulley 33 and the gear pulley 36.

As shown in FIGS. 1 and 2, a pair of base frames 38 are perpendicularly fixed on the slidable base 31 on both sides of the pair of support brackets 9, and both ends of a plurality of slide shafts 39 slidably penetrating through the pair of support brackets 9 are coupled to the pair of base frames 38.

The proximal end of a hydraulic cylinder 41 having a pulse encoder 40 as a driving source is coupled to the upper end of the left-hand support bracket 9 shown in FIGS. 1 and 2, and the distal end of a piston rod 42 that protrudes from the hydraulic cylinder 41 in a direction parallel to the timing belt 37 is coupled with the upper end of the right-hand base frame 38 shown in FIGS. 1 and 2.

The piston rod 42 of the hydraulic cylinder 41 is allowed to extend and contract by the pulse of the pulse encoder 40. For example, the piston rod 42 is allowed to extend or contract by 1 mm at four pulses, and by 100 mm at 400 pulses.

Figure 5:
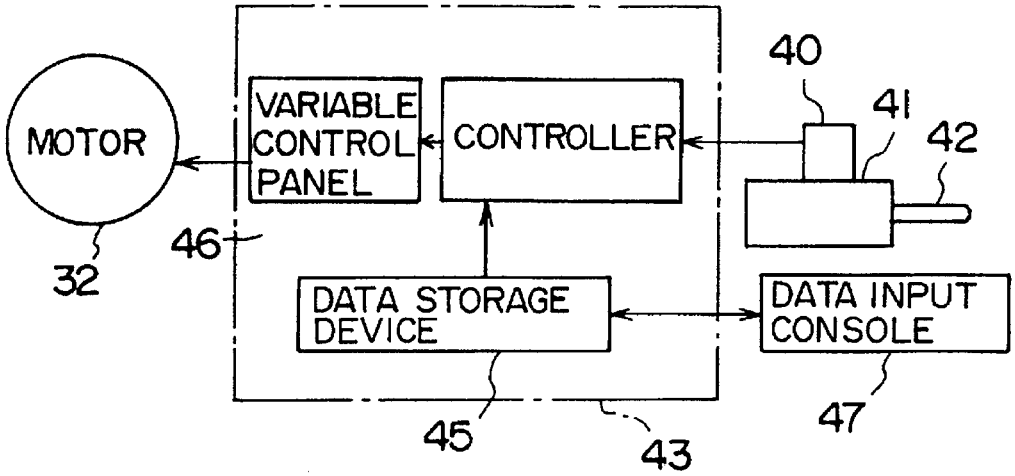
FIG. 5 is a control system diagram.

FIG. 5 shows a control system diagram of the motor 32 and the pulse encoder 40 described above. A controller 44, a data storage device 45 and a variable control panel 46 are disposed on a control panel 43, and a data input console 47 is connected to the data storage device 45.

The data storage device 45 is connected to the controller 44 and the controller 44 is connected to the pulse encoder 40 of the hydraulic cylinder 41 and to the motor 32 through the variable control panel 46.

Next, the function of the apparatus described above will be explained.

FIGS. 1, 2 and 6 show the state where the piston rod 42 of the hydraulic cylinder 41 as the driving source is most contracted. The piston rod 42 pulls the right-hand base frame 38 with the support bracket 9, to which the proximal end of the hydraulic cylinder 41 is coupled and which is under the fixed state, being the point of application of the pulling force, and the slidable base 31 is under the state where it slides and displaces to the extreme left.

Under this state, all of the first to fourth eccentric weights 27 to 30 are fixed to the first to fourth rotary shafts 20 to 23, respectively, so that they are under the eccentric state with the downward phase, as shown in FIG. 6.

When the motor 32 is actuated and the prime mover gear pulley 33 is driven for rotation clockwise as indicated by an arrow in FIG. 6, for example, under this state, the timing belt 37 passed around the prime mover gear pulley 33 and the gear pulley 36 circulatingly is driven clockwise, and rotates the first gear pulley 16 counterclockwise, the second gear pulley 17 clockwise, the third gear pulley 18 clockwise and the fourth gear pulley 19 counterclockwise, respectively.

The rotation of these first to fourth gear pulleys 16 to 19 is transmitted to the first to fourth rotary shafts 20 to 23 through the first to fourth gear pulley shafts 11 to 14 and through the individual universal joint shafts 26, respectively, and the first to fourth eccentric weights 27 to 30 are rotated with the first to fourth rotary shafts 20 to 23 being the center of rotation, respectively.

In this case, the rotating direction of the first rotary shaft 20 and the first eccentric weight 27 is opposite to the rotating direction of the second rotary shaft 21 and the second eccentric weight 28, and the rotating direction of the third rotary shaft 22 and the third eccentric weight 29 is opposite to that of the fourth rotary shaft 23 and the fourth eccentric weight 30.

The eccentric phase of the first eccentric weight 27 and the third eccentric weight 29 is symmetric in the transverse direction with the eccentric phase of the second eccentric weight 28 and the fourth eccentric weight 30, but their displacement phase in the vertical direction cooperates with each other and generates a large vertical vibration.

This vibration is transmitted from the first to fourth rotary shafts 20 to 23 to the support frame 5 through the bearing 25 and the bearing support table 24 shown in FIG. 4, and greatly vibrates the support frame 5 together with the concrete molding box 7 along the guide rods 4 in the vertical direction with a great amplitude.

Figure 7:
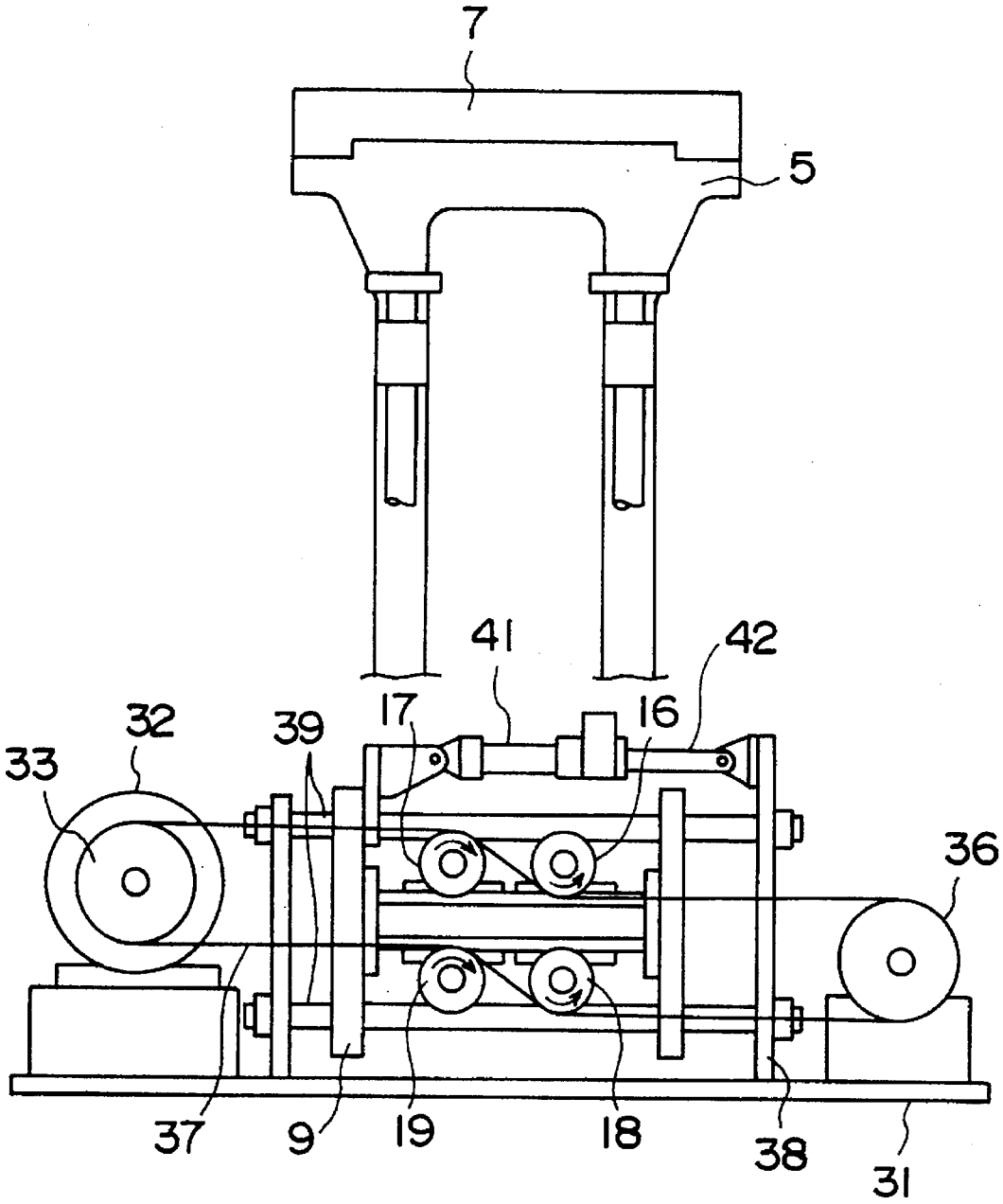
FIG. 7 is a front view of principal portions showing an operating state different from FIG. 6.
Figure 8:
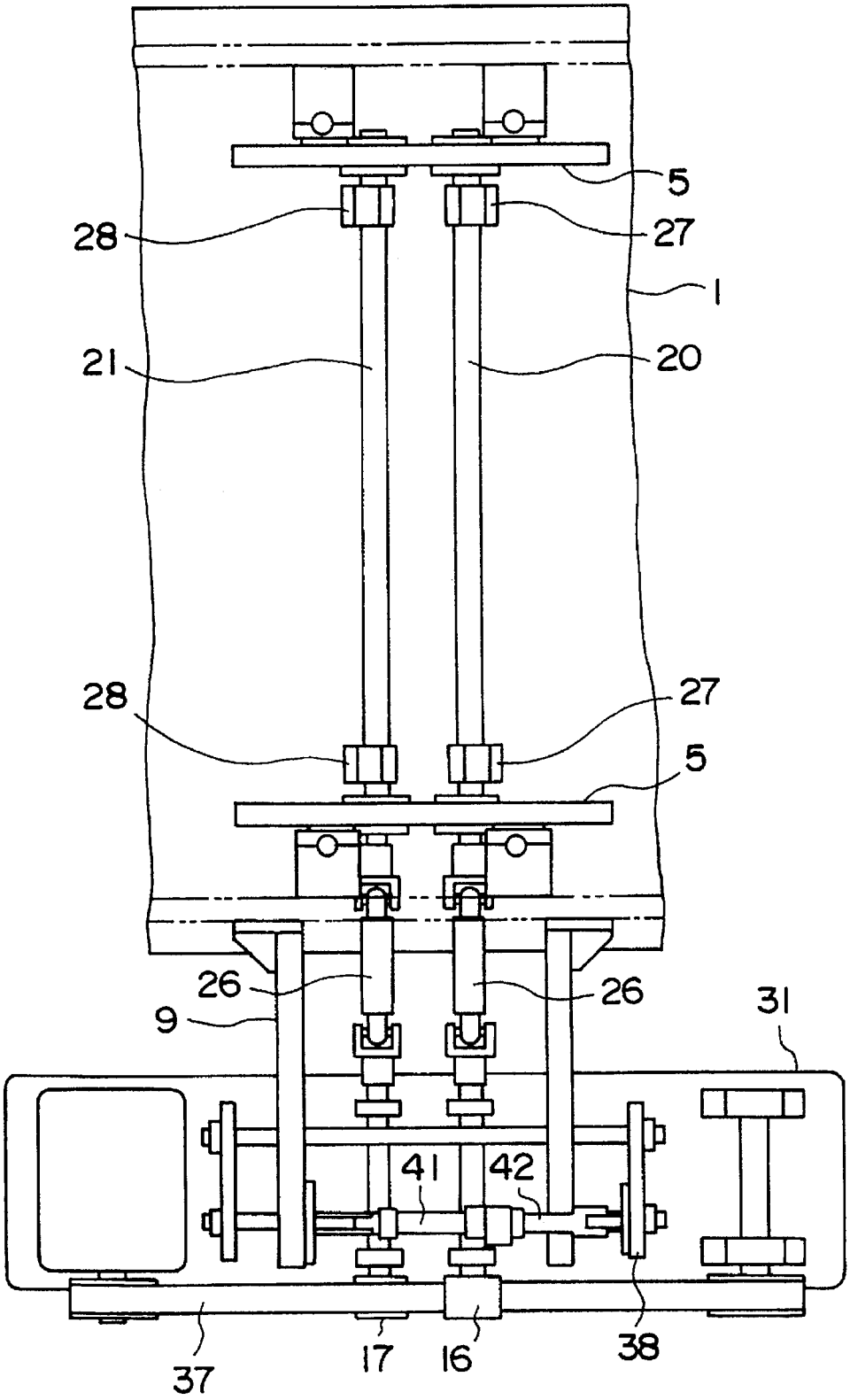
FIG. 8 is a front view of FIG. 7.

When the piston rod 42 of the hydraulic cylinder 42 is allowed to extend from the state shown in FIG. 6 where the piston rod 42 of the hydraulic cylinder 41 is most retracted, as shown in FIGS. 7 and 8, the piston rod 42 causes displacement of the right-hand base frame 38 to the right along with the slidable base 31, with the support bracket 9, which is under the fixed state as the proximal end of the hydraulic cylinder 41 is connected thereto, being the point of application of the pull force.

When the slidable base 31 undergoes displacement to the right, the motor 32, the prime mover gear pulley 33 and the gear pulley 36 undergo displacement to the right along with the timing belt 37.

When the timing belt 37 undergoes displacement to the right, the first gear pulley 16 and the third gear pulley 18 are rotated counterclockwise and the second gear pulley 17 and the fourth gear pulley 19 are rotated clockwise as indicated by an arrow in FIG. 7.

This rotation is transmitted to the first to fourth rotary shafts 20 to 23. When the piston rod 42 extends to maximum, the first eccentric weight 27 is at the position of the right-most eccentric phase while the second eccentric weight 28 is at the position of left-most eccentric phase and symmetric with the first eccentric weight 27 as shown in FIG. 9.

The third eccentric weight 29 exists at the position of the right-most eccentric phase in the same way as the first eccentric weight 27, and the fourth eccentric weight 30 is at the position of the left-most eccentric phase and symmetric with the third eccentric weight 29.

Figure 9:
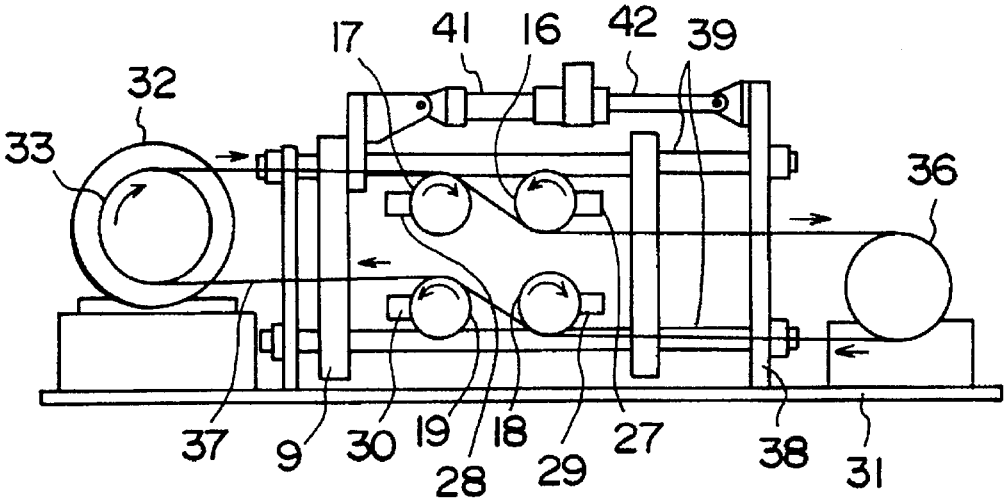
FIG. 9 is a front view of principal portions showing an operation state different from FIG. 7.

When the prime mover gear pulley 33 is rotated clockwise as indicated by an arrow in FIG. 6, for example, under the state shown in FIG. 9, the first and third eccentric weights 27 and 29 and the second and fourth eccentric weights 28 and 30 rotate with their vertical eccentric phases being opposite to one another, and the vibrations in the vertical direction are mutually offset. Therefore, the vibration in the vertical direction does not occur in the support frame 5 and the concrete molding box 7.

Figure 10:
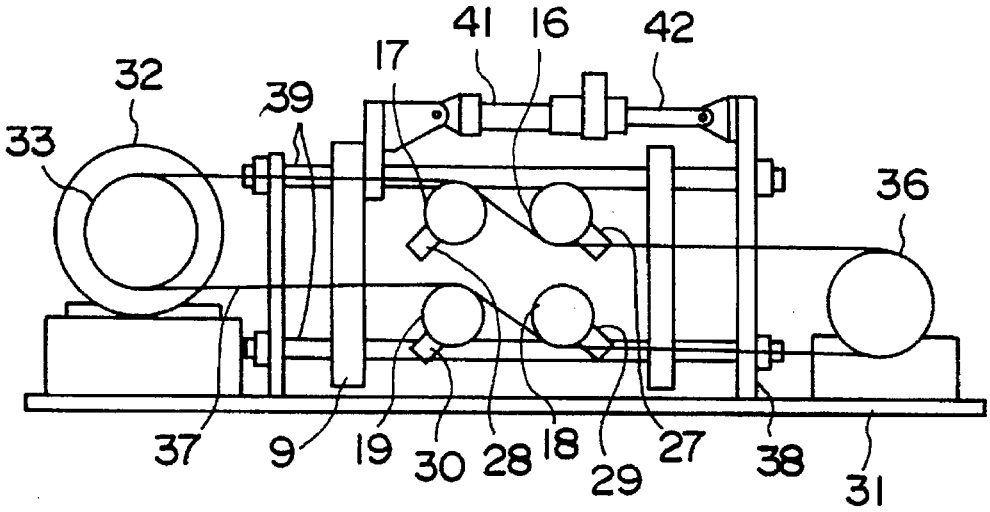
FIG. 10 is a front view of principal portions showing an operation state different from FIG. 9.

FIG. 10 shows the state where the piston rod 42 is extended to the medium degree. In this case, the first and third eccentric weights 27 and 29 take the eccentric position of the lower right phase, and the second and fourth weights 28 and 30 take the eccentric position of the lower left phase. All the eccentric weights take the intermediate eccentric phases between the eccentric phase shown in FIG. 6 and the eccentric phase shown in FIG. 9.

Accordingly, when the piston rod 42 is extended to the medium extent, the vibration of the medium level is transmitted to the support frame 5 and the concrete molding box 7, and the amplitude of this vibration is determined by the extension size of the piston rod 42.

The relationship between the phases of eccentricities of the first to fourth eccentric weights 27 to 30 and the magnitude of the vibration of the support frame 5 is stored in advance in the data storage device 45 shown in FIG. 5 on the basis of the data of trial operations. When a concrete product is molded, predetermined vibration data are inputted to the data input console 47 in accordance with the kind of the concrete product, its weight, conditions of the concrete material, etc, and the data storage device 45 selects the optimum amplitude from its memory data and inputs the optimum amplitude to the controller 44.

The controller 44 sends the number of phases corresponding to the selected amplitude to the pulse encoder 40, and controls the extension length of the piston rod 42 so as to generate the required amplitude.

The controller 44 controls the rotating speed of the motor 32 through the variable control panel 46, and can control the vibration state, too, by controlling frequency.

When the extension length of the piston rod 42 is controlled while the prime mover gear pulley 33 is rotated by the motor 32 and the support frame 5 and the concrete molding box 7 are being vibrated, the slidable base 31, the motor 32, the prime mover gear pulley 33 and the timing belt 37 undergo displacement horizontally while the timing belt 37 is circulatingly driven, and the amplitude can be controlled by changing the eccentric phase of the first to fourth eccentric weights 27 to 30 in this way.

The fitting position of the eccentric weight of each rotary shaft may be at both end portions of the rotary shaft as in the embodiment described above, or may be moved towards the center portion.

The first aspect of the present invention provides the effect that the amplitude of the concrete molding box can be continuously regulated over a broad range by changing the eccentric phases of the eccentric weights.

The second aspect of the invention provides the effect that the amplitude of vibration can be easily set in accordance with the concrete product.

What is claimed is:

1. A vibration apparatus for a concrete molding box comprising:

a first rotary shaft having an eccentric weight fixed thereto;

a third rotary shaft having an eccentric weight fixed thereto, and horizontally disposed immediately below, and in parallel with, said first rotary shaft;

a second rotary shaft disposed in parallel with said first rotary shaft and having an eccentric weight fixed thereto, said eccentric weight being symmetric with that of said first rotary shaft;

a fourth rotary shaft horizontally disposed immediately below the second rotary shaft and in parallel with said third rotary shaft and having an eccentric weight fixed thereto, said eccentric weight being symmetric with that of said third rotary shaft;

said first to fourth rotary shafts having first to fourth gear pulleys for rotating said first to fourth rotary shafts, disposed on the same plane, respectively;

an endless timing belt passed around a prime mover gear pulley and a gear pulley in such a manner as to extend from the lower side of said first gear pulley to the upper side of said second gear pulley and from the lower side of said third gear pulley to the upper side of said fourth gear pulley; and a support frame for supporting a concrete molding box at the upper end thereof, and receiving the vibration of said first and second rotary shafts and the vibration of said third and fourth rotary shafts at the lower end thereof.

2. A vibration apparatus for a concrete molding box according to claim 1, which uses, as a driving source, a hydraulic cylinder having a pulse encoder for controlling a protruding size of a piston rod, and which further includes a data storage device for storing the relation between the phases of eccentricities of said eccentric weights and the magnitude of the vibration of said support frame, and a controller for operating said hydraulic cylinder through said data storage device on the basis of a vibration set input.

* * * * *

UNITED STATES PATENT AND TRADEMARK OFFICE

CERTIFICATE OF CORRECTION

PATENT NO. : 5,652,002
DATED : July 29, 1997
INVENTOR(S) : Shigeru Kobayashi

It is certified that error appears in the above-indentified patent and that said Letters Patent is hereby corrected as shown below:

The drawing sheet consisting of Fig. 5, should be deleted to be replaced with the following Fig. 5.

Signed and Sealed this

Twenty-fifth Day of November, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5 652 002

DATED : July 29, 1997

INVENTOR(S) : Shigeru KOBAYASHI

It is certified that error appears in the above-indentified patent and that said Letters Patent is hereby corrected as shown below:

Replace Figure 5 in the Patent with the following Figure 5:

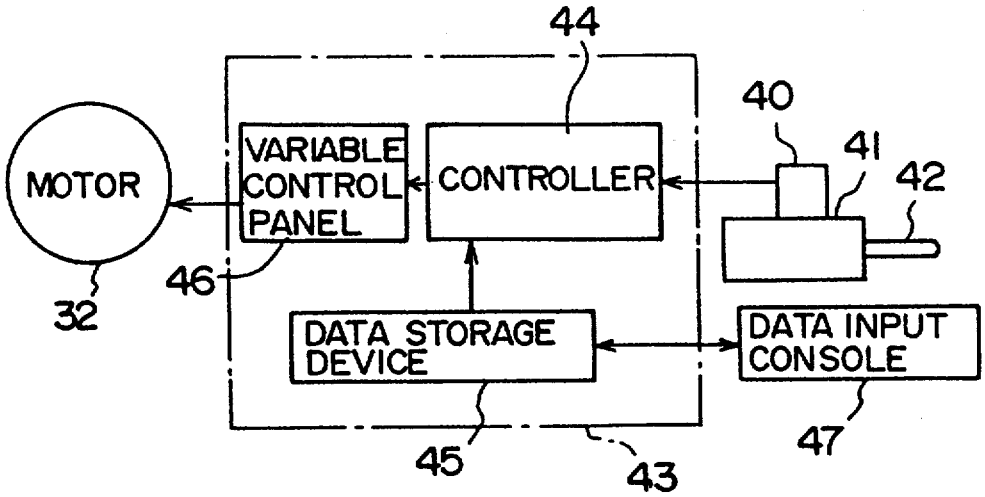

FIG. 5